United States Patent [19]

Rauenhorst

[11] 4,041,669

[45] Aug. 16, 1977

[54] HOLLOW-CORE CONCRETE SLABS

[76] Inventor: Gerald A. Rauenhorst, 6817 Oaklawn Ave., Minneapolis, Minn. 55435

[21] Appl. No.: 703,198

[22] Filed: July 7, 1976

Related U.S. Application Data

[63] Continuation of Ser. No. 549,140, Feb. 12, 1975, abandoned.

[51] Int. Cl.[2] ..... E04C 1/00

[52] U.S. Cl. ..... 52/576; 52/309.4

[58] Field of Search ..... 52/309, 576

[56] References Cited

U.S. PATENT DOCUMENTS

| | | | |
|---|---|---|---|
| 3,455,071 | 7/1969 | Müller | 52/576 |
| 3,885,296 | 5/1975 | Stout | 52/576 X |

FOREIGN PATENT DOCUMENTS

| | | | |
|---|---|---|---|
| 1,300,074 | 6/1962 | France | 52/576 |

*Primary Examiner*—J. Karl Bell

*Attorney, Agent, or Firm*—Schroeder, Siegfried, Ryan & Vidas

[57] ABSTRACT

A plastic foam core concrete plank and the method of making same is described which employs foamed plastic core forming members positioned on an initial layer of concrete in a forming pallet and held translationally and vertically in position relative to the initial layer of concrete as a top layer of concrete is poured into position around and over the core members to complete the slab. The core members have a plurality of discontinuous recesses extending from one surface thereof which are exposed to the lower or initial layer to create voids in the slab for light construction and to decrease the thermal transmissions therethrough.

10 Claims, 8 Drawing Figures

HOLLOW-CORE CONCRETE SLABS

This is a continuation, of application Ser. No. 549,140, filed Feb. 12, 1975 now abandoned.

My invention relates to hollow-core reinforced concrete slabs and more particularly to an improved method of making such slabs and an improved concrete slab construction. The concrete slab is cast in a horizontal position and when cured may be used for various purposes including walls, floors, partitions, and roof elements in building structures.

Hollow-core concrete cast slabs employing reinforcing steel members including prestressed and unstressed members are known and have been in use for many years. The formation of the hollow-core in such structures have employed a variety of methods of construction including the use of core forming members which are removed after the concrete in the slabs has set and also the use of core forming members which remain in the slab or are only partially removed after setting.

The prior construction which includes the removal of the hollow-core forming structure after setting of the concrete requires complex construction methods and machinery.

Where the core forming materials are permanently retained in part or in whole in the cast slab after construction of the same different problems are encountered. For some core forming materials the added weight is objectionable. For others of light weight core forming materials the cost of the core materials together with the problem of holding same in position during the construction of the slab presents special handling problems which add to the overall cost of the slab. The water absorption characteristics of certain of the core material creates problems during construction and also has tended to result in damage to the concrete slab in cold climates due to freezing of water that builds up in the cores in service. Dependent upon the shape of the core forming members and the voids in the concrete created thereby, the ratio of the strength of the slab to its weight may be less than optimum due to departure from the ideal plural I beam configuration. The thermal insulation characteristics of the resultant slab is also of great importance in many applications. Open channels allow free convection of air and have relatively poor thermal insulation characteristics. Where the core forming members are a foamed plastic material without large air voids, the desired thermal insulation is obtained at a significantly increased cost of core materials.

In the present invention, an improved hollow-core concrete slab is provided by use of foamed plastic core forming members having a plurality of spaced recesses or chambers therein with the walls between the chambers having a tapered shape for use during the construction of the concrete slab. The configuration of the core forming members provides the required rigidity in the core forming members during the manufacturing operation, and in the finished concrete slab also provides air voids of the discontinuous type within the slab for good thermal insulation with low volume of plastic material. The core forming member shape provides a conservation in core material and thus a reduced slab cost. The core forming member shape in accordance with the invention permits the core members to be more readily retained in position during the casting operation while at the same time provides a virtually ideal plural I beam configuration. The resultant hollow-core concrete slab has good strength to weight ratio while also possessing the desired low thermal conductivity properties.

Where hollow-core concrete slabs of the present construction are used horizontally with the end portions supporting walls spacing of the core forming members from the end of the slab will provide solid concrete extremities and thus eliminate the need for filling the ends of the hollow-core members as a separate manufacturing step.

Thus, the improved core forming material shape simplifies the manufacturing operation and permits varying lengths and sizes of slabs for an economy in construction and cost. Further, the improved core material provides for a desired hollow-core configuration approaching the ideal plural I-beam cross section for greater strength with reduced slab weight resulting in an economy in the amount of concrete and core forming material employed therein.

The improved core members are preferably made of a light weight foamed plastic material such as polystyrene or polyurethane.

Therefore, it is an object of this invention to provide an improved method of forming hollow-core reinforced concrete slabs.

Another object of this invention is to provide an improved core forming member for use in manufacture of hollow-core concrete slabs.

A further object of this invention is to provide an improved hollow-core concrete slab construction employing a retained core forming member which provides a desired void region within the slab for reduced weight and significantly reduced costs.

Another object of this invention is to provide a hollow-core concrete slab construction in which the core forming members may be longitudinally spaced from one another to provide alternate solid and hollow areas in a slab.

It is a still further object of the invention to provide a hollow-core concrete slab having good thermal insulation properties.

It is also an object of this invention to provide an improved light-weight core forming member which may be readily positioned and retained in position in the formation of the construction of concrete slabs.

These and other objects of this invention will become apparent from the reading of the attached description together with the drawings wherein.

The invention is shown and will be described herein in connection with concrete slab making machinery in which a mold form and concrete dispensing equipment are moved relative to one another in the continuous construction of the slabs in mold forms of great length. Such slabs, after cure, are sawed to the desired lengths. The same product may also be produced at a job site without the machinery to be described and may be cast to the desired length rather than cutting to size after cure.

Figure 1:
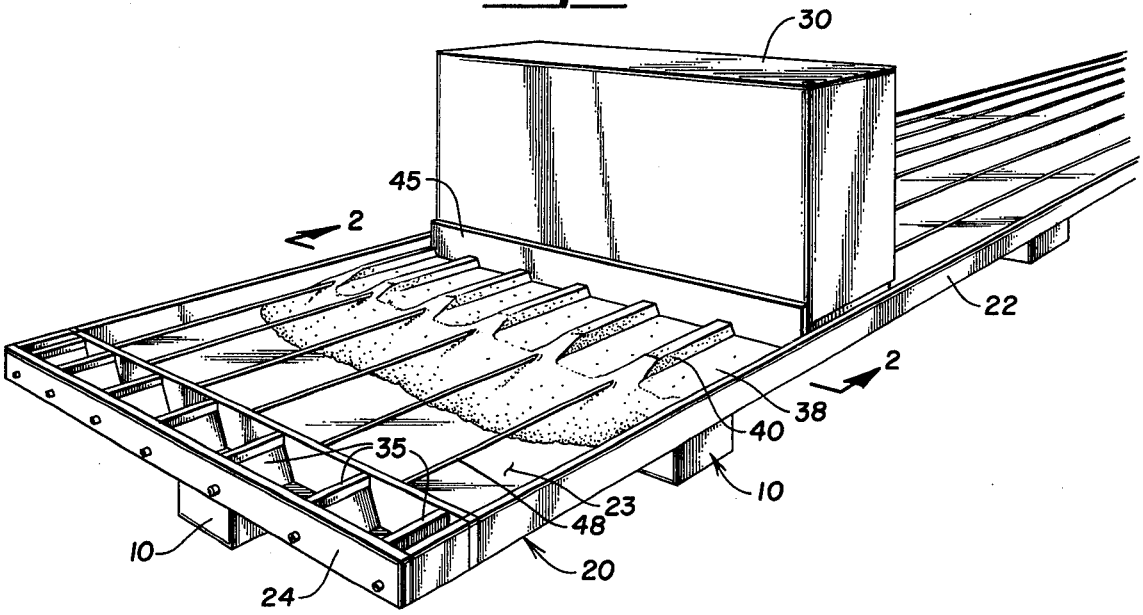
FIG. 1 is a perspective and schematic view of the apparatus for constructing hollow core concrete slabs including a mold form in which the slab is constructed.

In FIG. 1, numeral 10 indicates generally a base structure upon which is positioned a mold form generally designated 20 having removable or outwardly pivoting side plates 22 and a bottom pallet 23. End plates 24 may be used although they are not required. Ordinarily, end plates, such as plates 24, will not be used where a member of great length is to be cast and subsequently cut to the desired lengths.

The numeral 30 schematically identifies the concrete dispensing hopper and associated apparatus. Hopper 30 has been shown in schematic form. It may be of the conventional "V" shaped type with pneumatically operated flapper vanes to control the rate of flow of the concrete. Hopper 30 may be held stationary with the mold 20 moving therebelow or the hopper 30 may be moved with the mold forms 30 remaining stationary. The techniques and apparatus for either a moving concrete dispenser or moving form are well known in the art and will not be further described herein. Of course, the apparatus schematically shown in the figures will be provided with rollers and supporting rails therefore, as required, dependent upon which member is to be moved. The end plates 24 of the individual mold form may include a suitable cable positioning structures 35. Where prestressing of the reinforcing cable is required conventional jacking heads will be used.

Figure 2:
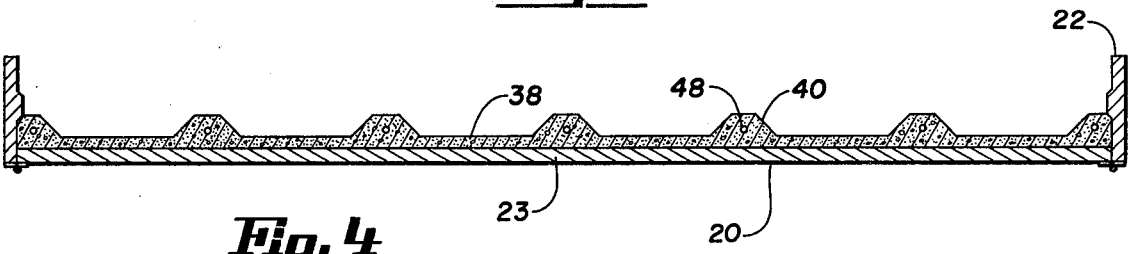
FIG. 2 is a sectional view of the mold form taken along the lines 2—2 in FIG. 1 with an initial soffit layer of concrete used in forming the slab therein.

As will be seen in FIGS. 1 and 2, as an initial step the bottom of the pallet of the mold form 20 is covered with a uniform layer 38 of the concrete material, by hopper 30, which layer in the embodiment shown is shaped during pouring of the first layer of concrete so as to have ridges 40 formed therein for purposes to be described below. The ridges in the bottom layer of concrete are conveniently produced by a shaping screed 45 which is joined to hopper 30 and moved therewith during pouring of layer 38 to shape same.

The ridges of concrete 40 will ordinarily, where greater strength is required in the final slab, be formed around a reinforcing steel cable member 48 which may be either prestressed or unstressed. Cable 48 is held in position in the mold and is positioned in the ridges 40 through the rod holding and/or tensioning structures 35 attached to the ends of the mold and by guide members (not shown) adjacent to hopper 30. As will be seen in FIG. 5, additional spacing rods or steel bars 50 bent in a configuration of the initial layer of concrete 38 with the ridges 40 therein, may be positioned over the initial layer 38 for transverse strengthing.

Figure 4:
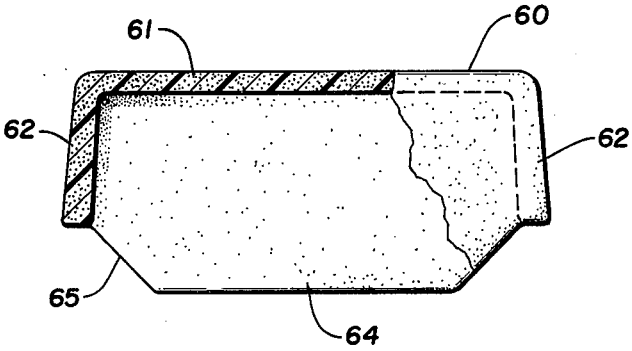
FIG. 4 is a section elevation of the core member taken along the lines 4—4 in FIG. 3.
Figure 3:
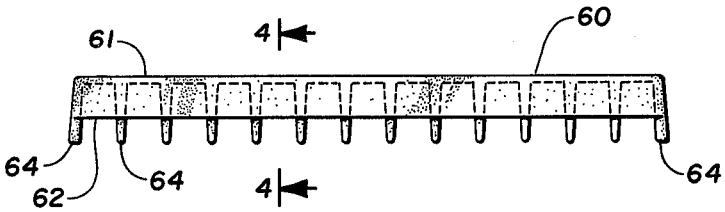
FIG. 3 is a side elevation view of a core forming member used in the formation of the hollow-core concrete slab with parts in phantom.

The core forming member 60 has a generally rectangular box-like configuration as can be seen in FIGS. 3 and 4 and has a continuous top 61, continuous downwardly extending side sections 62 with end sections and divider sections of a similar shape 64 formed integral with and extending beyond the depth of the side sections 62. The divider and end sections 64 are tapered near their bottom extremity as at 65 to fit the configuration of the lower layer of concrete with the tapered side of the core member 65 riding against and slightly down into the raised ridges 40 of the lower layer of concrete 38.

The divider sections 64 and the end sections of member 60 define a plurality of spaced transversely extending recesses which in the completed hollow core concrete slab are not interconnected with one another.

Core forming members 60 are preferably made of a molded foamed plastic material, such as polyurethane or polystyrene or similar materials. Additional reinforcing sections, not shown, may extend longitudinally of the core member intermediate the sides thereof for interconnecting the divider members and the end members to increase the number of recesses therein and for rigidity purposes. Generally, the thickness of the top, ends, side and divider sections 61, 62 and 64 will be substantially similar, although the sides and divider sections may be tapered as desired. Foam density should be as low as strength requirements will permit. A weight of 2 to 4 pounds per cubic foot is satisfactory although lower of higher density can be used.

As an example of the physical size, the width of the core member 60 used in making an 8 inch thick slab of 8 foot width was about 13 inch with the overall length of about 48 inch and a wall thickness defining the top, sides and divider sections of about ½ inch. The height of the divider section was approximately 5 inches from the inner surface of top 61 while the downwardly extending sides extend approximately 3½ inches from the top. These sides with dividers define openings which face the lower concrete surface. The tapered portions 65 extend down along ridges 40 to aid in holding the core forming members against translational movement during the filling of the mold with the top layer of concrete.

Figure 5:
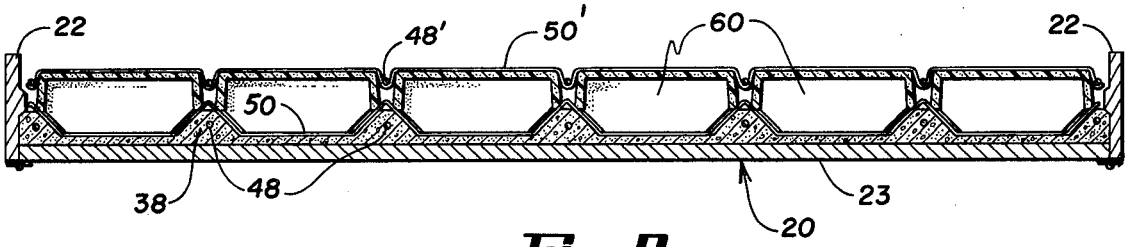
FIG. 5 is a sectional end view of the mold form at an intermediate stage of manufacturing showing the core forming members positioned on the initial layer of concrete.
Figure 6:
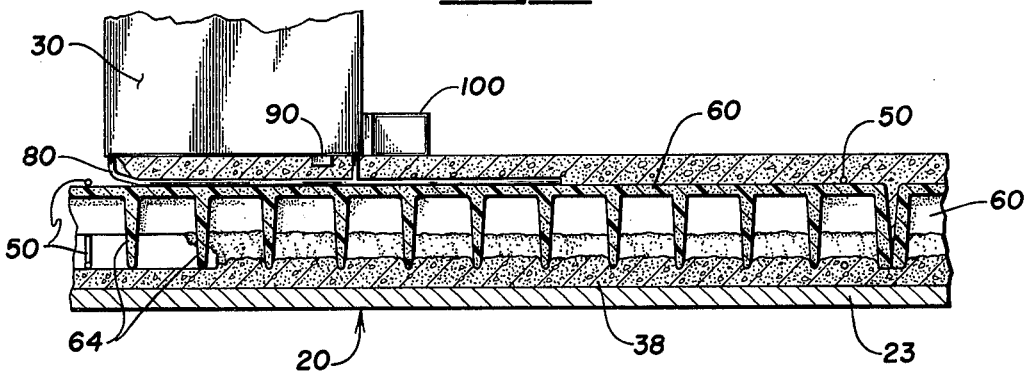
FIG. 6 is a side view of the slab making machinery with parts removed showing a plurality of core members in place and guide members for positioning the same during construction of the slab.
Figure 7:
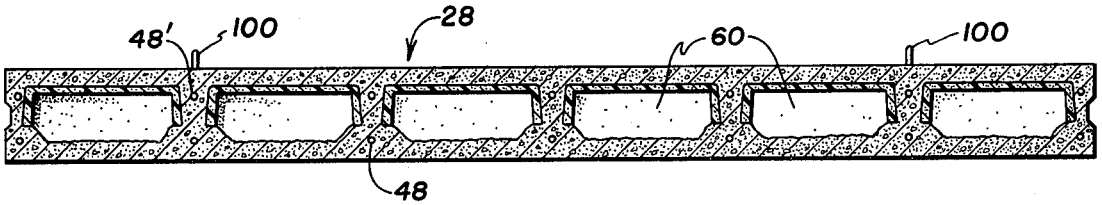
FIG. 7 is a sectional view of the completed concrete slab employing the improved core forming members and method of construction; and, FIG. 8 is a section view of the slab making machinery showing a plurality of core forming members in place and an alternate arrangement of guide members for positioning the same during construction of the slab.

As will be seen in FIGS. 5 and 6, the concrete slab is formed by positioning a plurality of core forming members 60 in spaced side-by-side relationship and end-to-end within the interior of the slab. The lower surface and beveled sides 65 of the member 60 bear against the layer 38 and ridges 40 to position the same for pouring the upper layer of concrete. As needed, spacing may be included between consecutive core forming members longitudinally to provide solid slab regions. By cutting the slab at such solid regions into given lengths a finished slab has solid ends of concrete that are especially useful when walls are to be erected thereon.

Alternatively, the core forming members 60 may extend continuously, without being longitudinally spaced, from one end plate 24 of the mold 20 to the other. Where greater strength is required reinforcing steel is positioned in the ridges 40 and an upper reinforcing cable 48' is positioned in the concrete web between the spaced and parallel core forming members. A preferred spacing between the core member of from 2 – 2½ inches provides a sufficient path for the concrete to flow between the core forming members and around the top reinforcing cable 48' positioned therebetween. This size of web gives the strength to the slab with a minimum of concrete weight. Although not required, a shaped wire form spacer member 50' may be located in the position shown across the tops of the core forming members 60. The downwardly extending sections of wire 50' are positioned to support the upper reinforcing rods 48' to hold the same in the desired relationship to the web.

As one example, concrete for the lower layer 38 had a slump of about 2½ inches and a slump of about 6½ inches for the web and top layer. The aggregate for the concrete was about ⅜ inch to permit free flow of the concrete around the core members 60, the web regions and for the upper surface of the slab. Other concrete mixtures can, of course, be utilized in the invention.

As will be seen in FIG. 6, after the core forming members 60 are positioned in the mold and on the lower concrete surface 38 with the reinforcing steel in position, relative movement is provided between the mold 20 and the hopper 30 during pouring of the concrete on top of and around the core forming members. Mold 20 with the lower layer of concrete 38 and the core members 60 therein is positioned beneath the discharge end of the hopper. The addition of the top layer of concrete must be before the lower layer 38 has set to insure a good bond between the upper and lower concrete.

Joined to the lower end of hopper 30 are guide members 80. These guides or skis are mounted to bear against the top of the core forming members 60 to aid in holding them in position in the mold as the much denser concrete material is poured over and around the same. The skis have a forward tine that extends beyond the hopper 30 as shown. The skis aid in preventing the core forming members from "floating" out of the position during the stage when the concrete is in motion either from pouring or vibrating. The concrete of layer 38 is of a fluid enough consistency to permit a slight amount of concrete to flow around the lower edges of the divider sections 64, but will prevent filling of the recesses defined by the divider sections by the more fluid concrete of the top and web. As the concrete encloses the core members 60, a slight vacuum appears to be created within the recesses of the core members 60 reducing any tendency for them to float out of place. The "egg crate" configuration reduces flotation tendency as any upward pressure of concrete is relieved in the air space of the recesses. Filling of the mold continues with the vibrators 90 aiding in the flow as desired, until the core forming members 60 are completely covered and a top layer covers the members 60 to a depth similar to the lower thickness 38.

A screed shown schematically as 100 level the concrete to the top of the mold. Vibrators are provided during the filling and leveling process to insure the uniform distribution of concrete around the core forming members and the steel reinforcing in the mold in the known way.

A typical slab of the type described may be of a width of 8 feet with an appropriate number of core members spaced in a side-by-side relationship to substantially fill the mold. The most common is 8 inches in thickness with the upper and lower soffit layer of concrete surrounding the core forming members being about 1¼ inch. The top and bottom soffits may be of greater or lesser thickness. Thickness less than ¾ inch are undesirable as the necessary strength is lacking at this point. The concrete between the core forming membets surrounding the reinforcing rods is about 2 inches thick, Again, thicker or thinner webs may be used but the concrete must be of a width to cover the reinforcing and provide the needed strength. Total slab thickness may vary from 4 to 12 inches or even larger with appropriate sized core members to give concrete soffits of about 1¼ inch. The resultant slab will have produced therein air voids of a volume considerably greater than that volume of the foamed plastic core forming material thereby significantly reducing the cost of foam plastic core material. Due to dividers 64, the construction has dead air pockets which give greatly improved thermal insulating properties over a construction with one elongated cavity. The resultant slab while still in the mold is cured, preferably by heating in the known way. The side plates 22 forming the mold will then be moved as by pivoting and the slab may be cut to the desired size.

During the formation and after smoothing, conventional lifting loops 100 may be inserted into the concrete in the region of the webs to provide a means for handling of the finished slab.

Rather than being constructed at a factory and then cut to length the slab may be constructed in an on-site location by positioning the core forming members 60 in a mold after an initial soffit layer is deposited and the reinforcing material is placed in the mold. The core members are held against the buoyancy action of the fluid concrete by holding the same in position as the mold is filled. Wire ties can be used that extend over the members 60 and are tied to the form or in some cases to reinforcing steel 48. The core members 60 will extend the entire length of the completed slab or near the ends of the same significantly reducing the overall weight of the same and increasing the thermal insulation characteristics.

Figure 8:
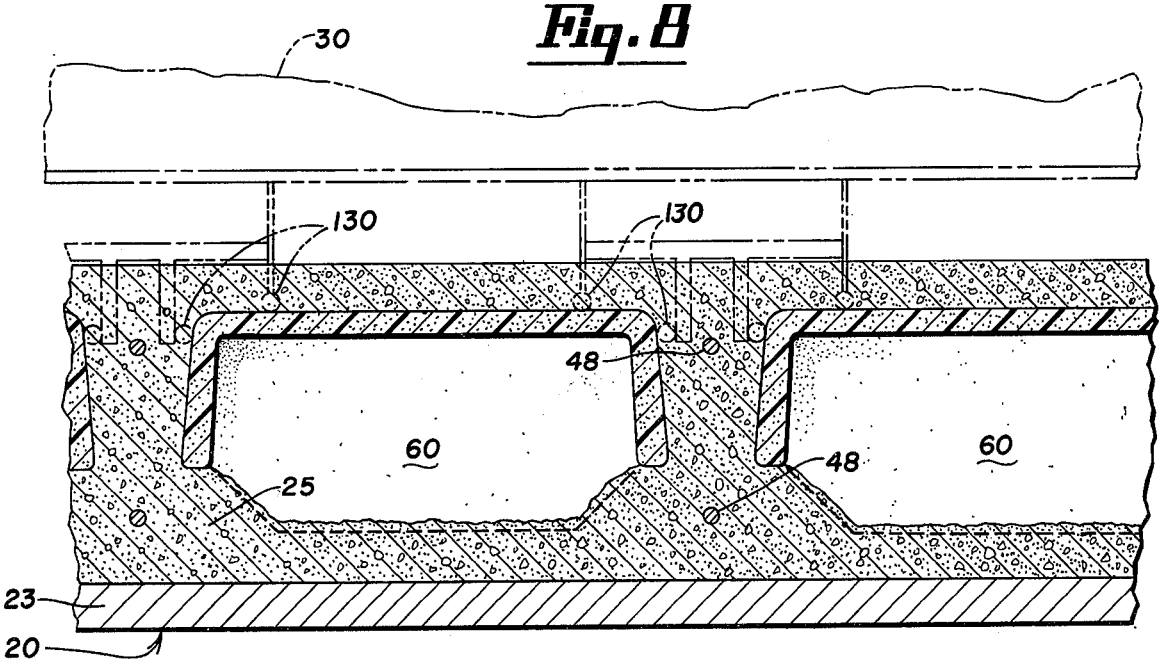

As an alternative method of construction, as shown in FIG. 8, the use of the ridged lower layer may be omitted and the lower surface may be made completely flat with the reinforcing rods 48 positioned at the desired elevation therein after which the core members 60 may be located in the mold and held in position by side ski members 130 which engage the top and sides of the core members to prevent translational as well as vertical movement during the filling and finishing operation. The concrete forming the webs flows outwardly, as shown, to produce a configuration similar to 40 of FIG. 2.

The improved method of construction and the improved core forming member shape provides a resultant hollow core concrete slab configuration in which the webs between the upper and lower surface of the slab are generally I-shaped in form for maximum of strength. In addition, the core forming member 60 may be shaped to provide a minimum core material for a economy in the cost of the same while at the same time providing a significant void area which is discontinuous with a layer of foamed plastic on one side thereof to provide for increased thermal efficiency of the resultant hollow core concrete slab. The improved method including the spacing of the core forming members and the holding of the same against vertical and translational movement insures for accurate positioning of the core forming members within the slab thereby providing uniformity of strength and increased theremal insulation efficiency.

It is also contemplated that the core forming members can be placed in parallel arrays transversely of the length of the slab so as to serve to lighten the weight of a bearing wall. Other modifications will also be apparent to these skilled in the art.

Therefore, in considering this invention, it should be remembered that the present disclosure is illustrative only and the scope of the invention should be determined by the appended claims.

What is claim is:

1. A hollow-core concrete slab comprising an integral body of concrete and at least one foamed plastic core forming member positioned therewith so that concrete completely surrounds the core member at least along the length direction of said concrete slab, said core forming member being an integral structure of a top member having end, side and intermediate wall members extending at approximately right angles downwardly therefrom to define a plurality of recesses with open faces of a depth substantially equal to the height of said wall members to define voids in said slab which contains neither concrete nor foamed plastic.

2. The hollow-core slab of claim 1, wherein the slab has a plurality of said core forming members positioned therein spaced and parallel relationship along the length of said slab.

3. The hollow-core slab of claim 1 wherein the recesses are sealed from access to one another by concrete covering the open faces of said recesses.

4. The hollow-core slab of claim 1 in which the recesses in the core forming members have a greater volume than the material in the core forming member.

5. The hollow-core slab of claim 1 wherein the intermediate walls of the core members are tapered in thickness toward the open faces of the recesses.

6. An elongated hollow-core concrete slab comprising, an integral body of concrete and a plurality of foamed plastic core forming members positioned therewithin in spaced and parallel relationship along the length of said slab so that the concrete completely surrounds the core members at least along the length direction of said concrete slab, said core forming members being an integral structure of an elongated top member having side longitudinal wall members extending at approximately right angles downwardly therefrom and having end wall members and intermediate wall members extending downwardly from said top and sidewall members to define with said top member and side wall members a plurality of deep recesses which contains neither concrete nor foamed plastic, and said end wall members and said intermediate wall members extending a further distance from said top member than said side wall members.

7. A concrete slab in accordance with claim 6 wherein the portions of said end wall members and intermediate wall members extending beyond said side wall members are tapered at each end thereof.

8. A concrete slab in accordance with claim 7 wherein said top, side wall and end wall members are of approximately the same thickness.

9. A concrete slab in accordance with claim 6 wherein said concrete extends across the open end of said recesses to define a plurality of closed voids.

10. A concrete slab in accordance with claim 9 wherein the recesses in the core forming members have a greater volume than the material in the core forming member.

* * * * *

UNITED STATES PATENT OFFICE

CERTIFICATE OF CORRECTION

PATENT NO. : 4,041,669

DATED : August 16, 1977

INVENTOR(S) : Gerald A. Rauenhorst

It is certified that error appears in the above-identified patent and that said Letters Patent are hereby corrected as shown below:

Column 6, line 68: delete "is" insert --I--

Column 7, line 3: delete "therewith" insert --therewithin--

Column 7, line 15: after "therein" insert --in--

Signed and Sealed this

*Twenty-ninth* Day of *November 1977*

[SEAL]

*Attest:*

RUTH C. MASON
*Attesting Officer*

LUTRELLE F. PARKER
*Acting Commissioner of Patents and Trademarks*